US006918750B2

(12) United States Patent
Geus et al.

(10) Patent No.: US 6,918,750 B2
(45) Date of Patent: Jul. 19, 2005

(54) ARRANGEMENT FOR THE CONTINUOUS PRODUCTION OF A FILAMENT NONWOVEN FIBROUS WEB

(75) Inventors: Hans-Georg Geus, Niederkassel-Rheidt (DE); Detlef Frey, Niederkassel (DE); Peter Schlag, Troisdorf (DE)

(73) Assignee: Reifenhauser GmbH & Co. Maschinenfabrik, Troisdorf (DE)

( * ) Notice: Subject to any disclaimer, the term of this patent is extended or adjusted under 35 U.S.C. 154(b) by 186 days.

(21) Appl. No.: 10/375,892

(22) Filed: Feb. 27, 2003

(65) Prior Publication Data

US 2003/0178742 A1 Sep. 25, 2003

(30) Foreign Application Priority Data

Feb. 28, 2002 (EP) ..... 02004615

(51) Int. Cl.[7] ..... B29C 55/00

(52) U.S. Cl. ..... 425/66; 425/72.2; 264/210.8; 156/441

(58) Field of Search ..... 425/66, 72.2, 382.2, 425/378.2, 379.1, DIG. 17; 264/210.8, 211.14, 211.12, 103, DIG. 75; 156/441, 167, 166, 180, 181

(56) References Cited

U.S. PATENT DOCUMENTS 5,460,500 A * 10/1995 Geus et al. ..... 425/66
5,814,349 A * 9/1998 Geus et al. ..... 425/66
6,607,624 B2 * 8/2003 Berrigan et al. ..... 156/167

FOREIGN PATENT DOCUMENTS

| | | |
|---|---|---|
| DE | 39 29 961 C1 | 1/1991 |
| DE | 196 20 379 C2 | 11/1997 |
| DE | 196 20 379 | 11/1997 |
| EP | 0 334 604 | 9/1989 |

* cited by examiner

*Primary Examiner*—Joseph S. Del Sole
(74) *Attorney, Agent, or Firm*—Herbert Dubno

(57) ABSTRACT

A spun-bond web-making apparatus has the cooling passage below the spinneret provided with a plurality of air chamber sections which are supplied with air at different temperatures, the cooling passage being connected to the drawing unit for aerodynamic stretching of the filaments without a gap through which external air can be supplied.

20 Claims, 5 Drawing Sheets

ARRANGEMENT FOR THE CONTINUOUS PRODUCTION OF A FILAMENT NONWOVEN FIBROUS WEB

FIELD OF THE INVENTION

Our present invention relates to an apparatus for the continuous production of a non-woven fibrous web, (i.e. a spun-bond web). More particularly the invention relates to the production of spun-bond from aerodynamically stretched filaments made from thermoplastic plastics (synthetic resins).

BACKGROUND OF THE INVENTION

An apparatus for the production of spun-bond can comprise a spinneret, a cooling chamber into which processing air for the cooling of the filaments can be introduced from an air supply chamber, a stretching unit having a lower draft channel and having a deposit or collections unit for depositing the filaments for the non-woven fibrous web or mat. The term "processing air" defines cooling air for cooling the filaments.

A known arrangement of the type is described in (DE 196 20 379 C2 and U.S. Pat. No. 5,814,349), which this invention is based upon. This apparatus is generally proven for the production of a non-woven fibrous web made from aerodynamically stretched filaments. In this arrangement the stretching unit is aerodynamically decoupled from a tiering system (i.e. a system for laying down the filaments in overlapping relationship), which is provided with a diffuser. Here, a clear functional separation of the stretching unit and from the tiering unit exists.

For this purpose, the lower draft channel, with respect to the thickness of the gap, is embodied as a barring air shaft aerodynamically separating the tiering unit from the stretching unit. The term "barring air shaft" means that during operation the lower draft channel continuously releases processing air, which enters the diffuser. However this air has a mass flow and kinetic energy which prevents pressure changes in the tiering unit from causing disturbing affects on the aerodynamic conditions in the air flow system and/or in the cooling chamber and vice versa. Therefore, in this arrangement the cooling process and/or the air flow process in the cooling chamber can be optimized without interfering with the optimization of the tiering process and thus, the formation of the non-woven fibrous web.

On the other hand, the tiering system can be optimized with respect to the formation of the non-woven fibrous web, without subjecting the air flow system and/or the cooling system to interference.

The cooling chamber of this arrangement allocated underneath the spinneret is additionally provided with an air flow blower by which the processing air for cooling the filaments is blown onto the filaments. However, when the speed of the filaments and the fineness of the filaments is to be increased (e.g., reducing the titers to values distinctly lower than 1), arrangements of the known type reach their limits. The air flow in this arrangement is not suitable for higher throughputs, because problems arise in the formation of the filaments. The resulting self-movement of the filaments leads to the filaments moving toward each other and thus, they can only be deposited in the form of filament bundles. Increasing the air speed in the arrangement described in order to increase the filament speed leads to an intensified cooling of the filaments. This intense cooling causes a premature solidification of the filaments and thus limits the filament speed and/or the filament fineness.

OBJECTS OF THE INVENTION

The principal object of our invention is to provide an apparatus which is free from the last mentioned drawback.

Another object is to provide an arrangement of the type mentioned at the outset, in which higher filament speed and increased filament fineness can be achieved and in which the above-mentioned problems can efficiently be avoided.

SUMMARY OF THE INVENTION

These objects are attained in accordance with the invention in an apparatus of the type described at the outset, in which the air supply chamber next to the cooling chamber is divided into at least two chamber sections, from which processing air with different temperatures can be introduced, and with the connection of the cooling chamber and the stretching unit being fully closed and embodied free from incoming air flow.

More particularly the apparatus comprises:

a spinneret for producing a descending curtain of thermoplastic synthetic resin filaments;

a cooling chamber below the spinneret and forming a passage receiving the descending curtain of thermoplastic synthetic resin filaments;

a stretching unit below the passage and connected thereto to exclude entry of external air for aerodynamically stretching the filaments as the filaments pass downwardly from the passage through the stretching unit, the stretching unit having a draft channel at a bottom thereof;

an air supply chamber adjacent the cooling chamber and communicating with the passage through openings in walls of the cooling chamber for introducing process air into the passage, cooling the filaments and passing with the filaments into the stretching unit, the air supply chamber being subdivided into a first chamber section and a second chamber section in a direction of travel of the filaments provided with means for introducing air of different temperatures into the passage; and a collecting device below the stretching unit for collecting aerodynamically stretched filaments in the form of a continuous web.

The scope of the invention includes that the air supply chamber comprises at least two chamber sections arranged vertically on top of one another. Advantageously, two chamber sections are arranged vertically on top of one another only.

According to a preferred embodiment of the invention processing air having a temperature between 15° C. and 75° C., preferably between 18° C. and 70° C. can be introduced from a first chamber section, and processing air having a temperature between 15° C. and 38° C., preferably between 18° C. and 35° C. can be introduced from a second chamber section.

Advantageously, the first and the second chamber sections are arranged vertically and the first chamber section forms the upper chamber section and the second chamber section forms the lower chamber section. It is therefore a feature of this invention that the air introduced from the upper chamber section has a higher temperature than the air introduced from the lower chamber section. As a general matter, however, it is possible for the air introduced from the upper chamber section to be of a lower temperature than the air introduced from the lower chamber section.

Preferably, at least one blower for the introduction of processing air is connected to each chamber section. Means is preferably provided so that the temperature of each chamber section can be adjusted. Furthermore, the mass flow of the air in the individual chamber sections can be adjusted. By adjusting the mass flow and the temperature of the upper chamber section, in particular, the cooling of the filaments can be reduced such that higher filament speeds are possible and finer filaments can be spun.

In the arrangements known from prior art the air supply chamber is commonly identified as the air blow chamber. In these arrangements a controlled air flow onto the filaments and/or to the filament bundles occurs. According to another aspect of the present invention no air flow is directed onto the filaments and/or to the filament bundles. To the contrary, the processing air is drawn in by the filaments and/or the filament curtain. In other words, the filament bundles suck in the processing air necessary. Therefore, the scope of this invention includes that the cooling chamber is equivalent to a passive system, in which processing air is not blown onto the filaments, but rather processing air is drawn out of the chamber sections. A framing air pocket forms concentrically around each of the individual filaments and, due to the structure of these boundary layers, the filaments and/or the filament bundles entrain the processing air. The boundary layers ensure a sufficient distance of the filaments from one another. Abstaining from an active air flow effectively contributes to eliminating the possibility for the filaments to develop disturbing movements out of alignment and for the filaments to interfere with one another. Advantageously, honeycombs are provided between the cooling chamber and the chamber sections.

Due to the configuration of the cooling chamber and/or the division of the air supply chamber into chamber sections, and due to the possibility to introduce air flows of various temperatures and/or various mass flow an efficient separation and/or decoupling of the "spinning, cooling" section from the "stretching, lower draft" section can be achieved. In other words, the influence of changing pressure in the stretching unit has on the conditions in the cooling chamber can largely be compensated by the measures according to the invention. The aerodynamic decoupling is also supported and/or enhanced by the additional features described hereinafter.

The spinneret of the arrangement is provided with jet holes for the release of filaments. According to a very preferred embodiment, which is of particular importance within the scope of this invention, the mutual spacing of the jet holes of the spinneret in the center of the spinneret is larger than in the exterior regions. The spacing of the jet holes in the jet plate of the spinneret thus increases from the exterior towards the center. Due to this arrangement of the jet holes a sufficient minimum distance of the filaments can be ensured very effectively.

The air supply chamber can be spaced from the jet plate of the spinneret, advantageously at a few centimeters below the jet plate. A monomer suction device is arranged between the jet plate and the air supply chamber. The monomer suction device sucks air out of the filament formation chamber immediately below the jet plate which achieves the removal of gases released together with the polymer filaments, such as monomers, oligomers, decomposition products, and the like from the arrangement. Furthermore, the air flow below the jet plate can be controlled with the monomer suction device, which jet plate otherwise could not be stationary due to the indifferent conditions, the monomer suction device is advantageously provided with a suction chamber, to which preferably at least one suction blower is connected. Preferably, the suction chamber is provided with an initial suction gap in its lower section facing the filament formation chamber. According to a very preferred embodiment the suction chamber is further provided with a second suction gap in its upper section. Suction using this second suction gap effectively prevents the formation of disturbing turbulence in the region between the jet plate and the suction chamber. Advantageously, the suction mass flow can be controlled using the monomer suction device.

An intermediate channel can be provided between the cooling chamber and the stretching unit, with the intermediate channel conically narrowing (converging downwardly), as seen in a vertical section, from exiting the cooling chamber to entering the lower draft channel of the stretching unit. Advantageously, the intermediate channel narrows, in the vertical section, conically at the entry of the lower draft channel to the entry width of the lower draft channel. Preferably, different incline angles of the intermediate channel can be adjusted. The geometry of the intermediate channel can be adjustable in order to allow an increase in air speed. This way, undesired relaxations of the filaments occurring at high temperatures can be avoided.

The invention is based on our discovery that the above problems attacked by the invention can be solved effectively and, particularly, the filament speed and the filament fineness can be increased to a surprising extent, when the measures according to the invention are implemented. As a result, nonwoven fibrous webs with an optically high quality are produced. Furthermore, the invention is based on the discovery that an aerodynamic decoupling of the cooling of the filaments from the stretching of the filaments is necessary and that this aerodynamic decoupling can be achieved by implementing the described measures according to the invention. Essential according to the invention is here, primarily, the cooling chamber and/or the air supply chamber according to the invention and the possibility for adjusting various temperatures and mass flows of the air introduced. However, the other above-explained measures according to the invention add to the aerodynamic decoupling as well. The operation of filament cooling is functionally decoupled and/or aerodynamically decoupled from the filament stretching.

Here, "aerodynamic decoupling" means that, although pressure changes in the stretching unit affect the conditions in the cooling chamber for the filaments, these influences are largely compensated by the adjustment capabilities of the separated air flow.

A tiering unit with at least one diffuser can be provided adjacent to the stretching unit. Preferably, the tiering unit and/or the diffuser are multistaged, preferably two-staged.

The tiering unit can comprise an initial diffuser and a second diffuser following adjacently. Preferably, an ambient air entry gap is provided between the initial and the second diffuser. In the initial diffuser, a reduction of the high-air speed at the end of the lower draft channel, necessary for the stretching of the filaments, occurs. Thereby, resulting in a considerable-pressure recovery.

Preferably, the opening angle $\alpha$ is continuously adjustable in a lower diverging region of the initial diffuser. For this purpose, the diverging side walls of the initial diffuser are moveable. This adjustability of the diverging side walls can occur symmetrically or asymmetrically; with respect to the central level of the initial diffuser. At the beginning of the second diffuser an ambient air entry gap is provided. Due to the high exit momentum out of the initial diffuser stage secondary air from the surroundings is suctioned through the ambient air entry gap. Preferably, the width of the ambient air entry gap can be adjusted. Preferably, the ambient air entry gap can here be adjusted such that the mass flow of the suctioned secondary air amount up to 30% of the entering mass flux of the processing air. Advantageously, the second diffuser can be adjusted in height and, in particular, can be continuously adjusted in height. Thus, the distance to the deposit device and/or to the deposit screen can be varied. Here, it must be stressed that an effectively aerodynamical decoupling of the filament formation region and the deposit region can be achieved by means of the tiering device according to the invention.

The arrangement according to the invention can be provided with a tiering unit without any air guidance devices and/or without any diffusers. In this case, the filament-air-mixture exits from the stretching unit and immediately encounters the deposit unit and/or the deposit screen without any air guidance devices.

After exiting the stretching unit, the filaments can be electrostatically influenced and, for this purpose, are guided either through a static or a dynamic field. Here, the filaments are charged such that an interacting contact of the filaments is prevented. Advantageously, by way of a second electrical field, the filaments are then caused to move, which results in an optimal deposit. Any potential charge still present in the filaments will be discharged, for example, by way of a special conductive deposit screen and/or any suitable discharging devices.

The deposit device can be provided as a continuously moving deposit screen for the filament non-woven fibrous web and at least one suction device provided underneath the deposit screen. The minimum single one suction device is preferably embodied as a suction blower which, can be controlled and/or adjusted.

At least three suction regions can be positioned behind one another in the web travel direction of the deposit screen and below it, with one primary suction region being arranged in the deposit region of the filament non-woven fibrous web, with a first suction region being provided in front of the deposit region and with a second suction region being provided behind the deposit region. Thus, the first suction region is arranged, in the production direction, in front of the deposit region and/or in front of the primary suction region and the second suction region is arranged behind the deposit region and/or the primary suction region in the production direction. The primary suction region can be separated from the first suction region and from the second suction region by respective walls. Preferably, the walls of the primary suction region are embodied in the form of jets. The scope of the invention includes for the suction speed in the primary suction region to be higher then the suction speed in the first suction region and in the second suction region. Using an arrangement according to the invention, the filament speed and the filament fineness can be increased considerably compared to the above-explained arrangements known from prior art. Therefore, higher filament throughput and filaments with finer tiers can be yielded. A reduction of the titers to values distinctly below 1 are possible without any problems.

The arrangement according to the invention is suitable for a wide range of applications, in particular, for polyester filaments as well. Using an arrangement according to the invention very evenly homogenous non-woven fibrous webs can be produced, which are characterized in an optically high quality.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
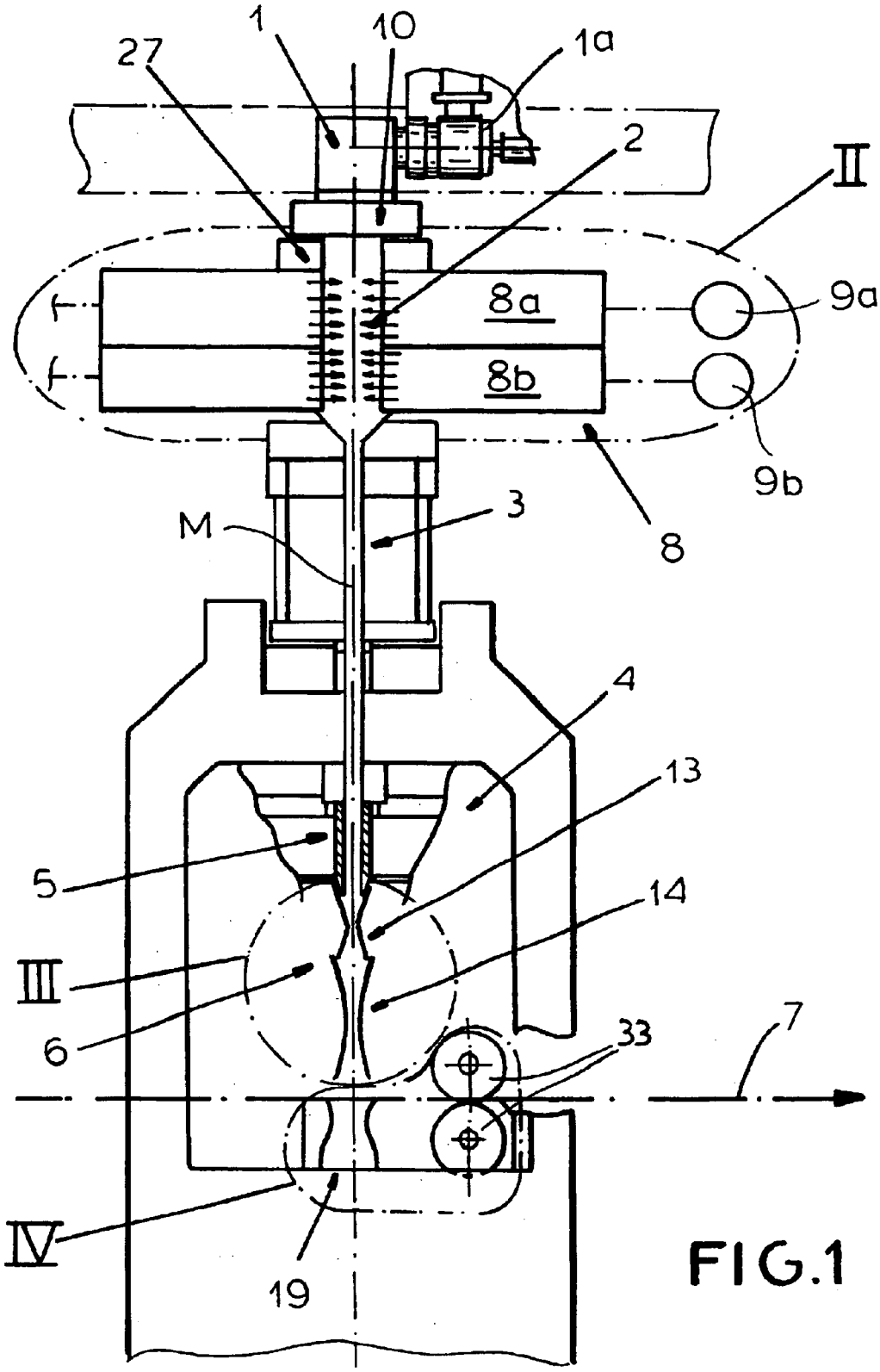
FIG. 1 is a vertical section through an arrangement according to the invention.

FIGS. 1 to 4 show an apparatus for the continuous production of a non-woven fibrous web made from aerodynamically stretched filaments made from thermoplastic plastics. The apparatus is provided with a spinneret 1 and a cooling chamber 2, arranged beneath the spinneret 1, into which cooling chamber processing air can be introduced for the purpose of cooling the filaments. The cooling chamber 2 is followed by an intermediate channel 3. Subsequent to the intermediate channel 3, a stretching unit 4 with a lower draft channel 5 follows. A tiering unit 6 is provided adjacent to the lower draft channel 5. Beneath the distribution unit 6 a deposit or collecting unit is provided in the form of a continuously moving collecting screen 7 for collecting the filaments for the non-woven fibrous spun-bond web.

Figure 2:
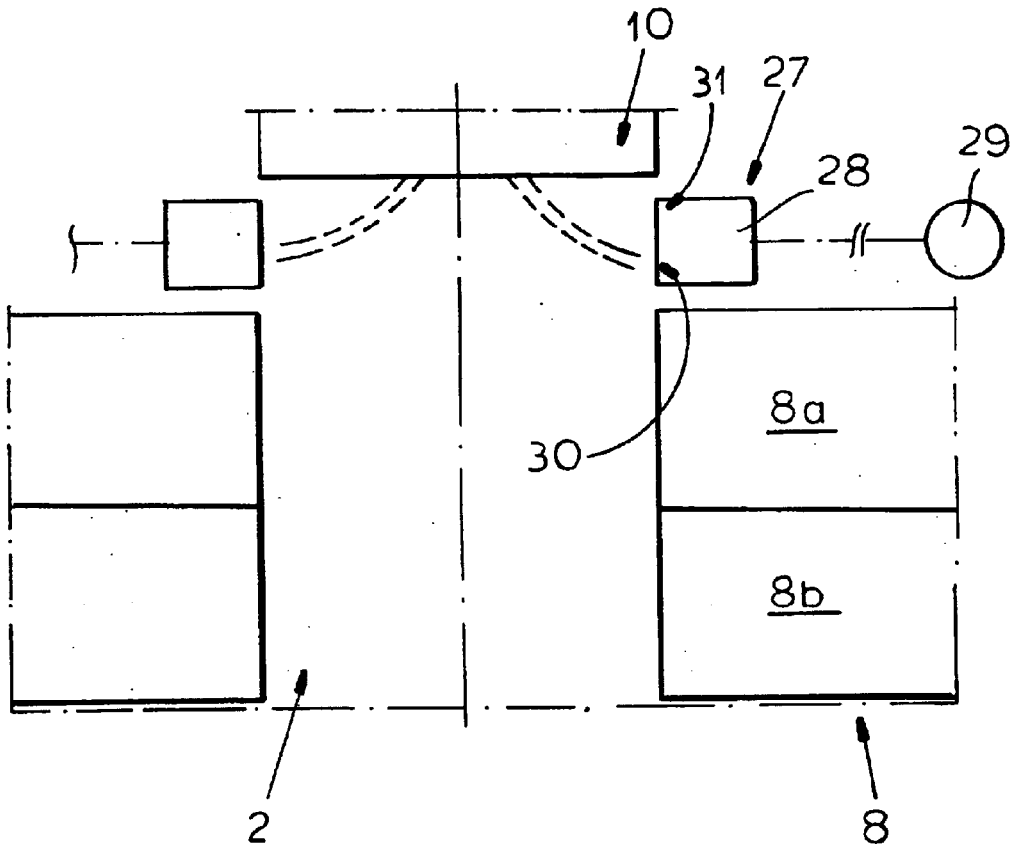
FIG. 2 is an enlarged section II of the object shown in FIG. 1.

FIG. 2 shows the cooling chamber 2 of the arrangement according to the invention and the air supply chamber 8 positioned adjacent to the cooling chamber 2. The air supply chamber 8 is divided into an upper chamber section 8*a* and a lower chamber section 8*b*. From the two chamber sections 8*a*, 8*b* processing air with different temperatures can be introduced into the filament passage of the cooling chamber.

Advantageously and as shown, the processing air enters the cooling chamber from the upper chamber section 8*a* with, a temperature ranging from 18° C. to 70° C. Preferably, processing air enters the cooling chamber 2 from the lower chamber section 8*b* having a temperature ranging from 18° C. to 35° C. Preferably, the processing air leaving the upper chamber section 8*a* has a higher temperature than the processing air leaving the lower chamber section 8*b*.

In general, the processing air leaving the upper chamber section 8*a* may also be provided with a lower temperature than the processing air leaving the lower chamber section 8*b*.

Here, the processing air is generally drawn in by the filaments leaving from the spinneret 1. One blower 9*a*, 9*b* each for, the introduction of processing air are connected to the chamber sections 8*a*, 8*b*.

The mass flow of the processing air introduced is also adjustable. According to the invention, the temperatures of the process air entering the respective upper chamber section 8*a* or the lower chamber section 8*b* is adjustable as well. It is also within the scope of this invention that the chamber section a, 8*b* are arranged both to the right and to the left of the cooling chamber 2. The left halves of the chamber sections 8*a*, 8*b* are connected to the respective blowers 9*a*, 9*b* as well.

It is particularly discernible from FIG. 2 that a monomer suction device 27 is provided between the jet plate 10 of the spinneret 1 and the air supply chamber 8, allowing any disturbing gas produced during the spinning process to be removed from the arrangement. The monomer suction device 27 is provided with a suction chamber 28 and with a suction blower 29 connected to the suction chamber 28. An initial suction gap 30 is provided in the lower section of the suction chamber 28. In the upper section of the suction chamber 28 a second suction gap 31 is provided additionally. The second suction gap 31 is narrower than the initial suction gap 30. Any interference between the jet plate 10 and the monomeric suction device 27 is prevented by the additional second suction gap 31.

It is discernible from FIG. 1 that the intermediate channel 3 narrows, in a cone-shaped manner in the vertical section, from the exit of the cooling chamber 2 to the entry into the lower draft channel 5 of the stretching unit 4, and that to the entry width of the lower tensile channel 5, advantageously and shown in the exemplary embodiment. According to a very preferred embodiment of the invention and seen in the exemplary embodiment various incline angles of the intermediate channel 3 can be adjusted. The lower draft channel 5 narrows, in a cone-shaped manner in the vertical section, towards the tiering unit 6. The channel width of the lower draft channel 5 is made adjustable as well.

Figure 3:
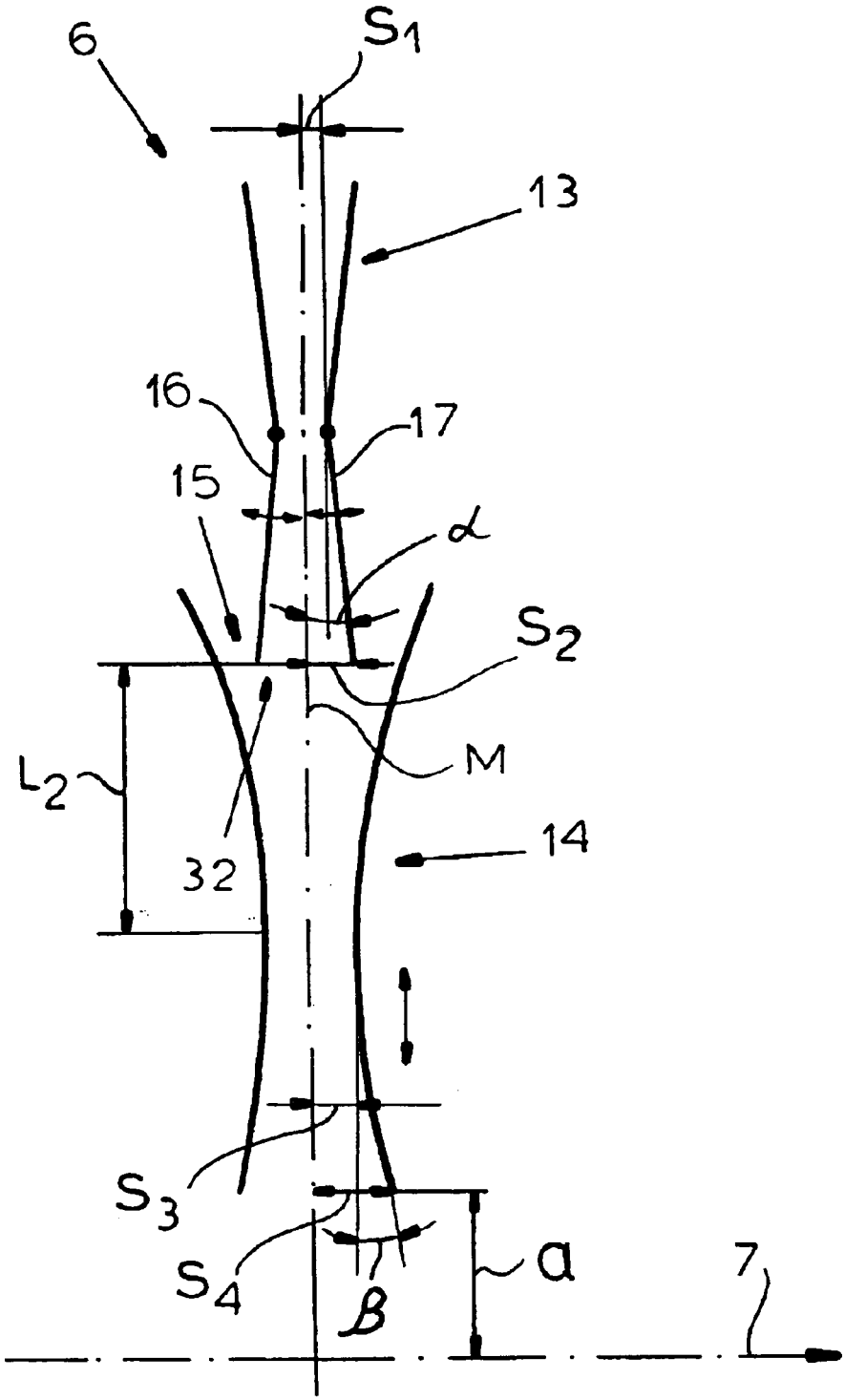
FIG. 3 is an enlarged section III of the object shown in FIG. 1.

Particularly in FIG. 3 it is discernible that the tiering unit 6 comprises an initial diffuser 13 and a second diffuser 14 following adjacently and that an ambient air entry gap 15 is provided between the initial diffuser 13 and the second diffuser 14. FIG. 3 shows that each diffuser 13, 14 is provided with an upper converging part and with a lower diverging part. Therefore, each diffuser 13, 14 is provided with a most narrow section between the upper converging part and the lower diverging part. A reduction of the high air speed at the end of the stretching unit 4 necessary for stretching the filaments occurs in the initial diffuser 13. Thus resulting in a considerable pressure recovery. The initial diffuser 13 is provided with a diverging section 32, with its side walls 16, 17 being adjustable in a hinged manner. In this way, an opening angle $\alpha$ of the diverging region 32 can be adjusted. This opening angle $\alpha$ ranges advantageously from 0.5° to 3° and amounts preferably to 1° or approximately 1°. The opening angle $\alpha$ can preferably be adjusted continuously. The adjustment of the side walls 16, 17 can occur either symmetrically or asymmetrically with respect to the medium plane M.

At the beginning of the second diffuser 14, secondary air is drawn by suction according to the injector principle through the ambient air entry gap 15. Because of the high exit momentum of the processing air of the initial diffuser 13 the secondary ambient air is sucked in this ambient air entry gap 15. The width of the ambient air entry gap 15 is adjustable. Furthermore, it is preferred for the opening angle $\beta$ of the second diffuser 14 to be continuously adjustable as well. Additionally, the second diffuser 14 is embodied to be adjustable in height. In this way, the distance a of the second diffuser 14 from the deposit screen 7 can be adjusted. Due to the adjustability in height of the second diffuser 14 and/or due to the hinged adjustability of the side walls 16, 17 in the diverging region 32 of the initial diffuser 13 the width of the ambient air entry gap 15 can be adjusted.

The ambient air entry gap 15 can be adjustable such that an incoming tangential flow of secondary air occurs.

Furthermore, some characteristic measurements of the tiering unit 6 are shown in FIG. 3. The distance s2 between the medium plane M and the side wall 16, 17 of the initial diffuser 13 is advantageously 0.8 $S_1$, to 2.5 $S_1$ ($S_1$ is the equivalent of the distance from the medium plane M to the side wall at the narrowest point of the initial diffuser 13. The distance $S_3$ of the central level M to the side wall amounts preferably to 0.5 $S_2$ to 2 $S_2$ at the narrowest point of the second diffuser 14. The distance $S_4$ of the medium plane M to the lower edge of the side wall of the second diffuser 14 is 1 $S_2$ to 10 $S_2$. The length L2 has a value of 1 $S_2$ to 15 $S_2$. For the width of the ambient air entry gap 15 different variable values are possible.

The assembly comprising the cooling chamber 2, the intermediate channel 3, the stretching unit 4, and the tiering unit 5 can form a closed system except for the air suction into the cooling chamber 2 and the air entry at the ambient air entry gap 15.

Figure 4:
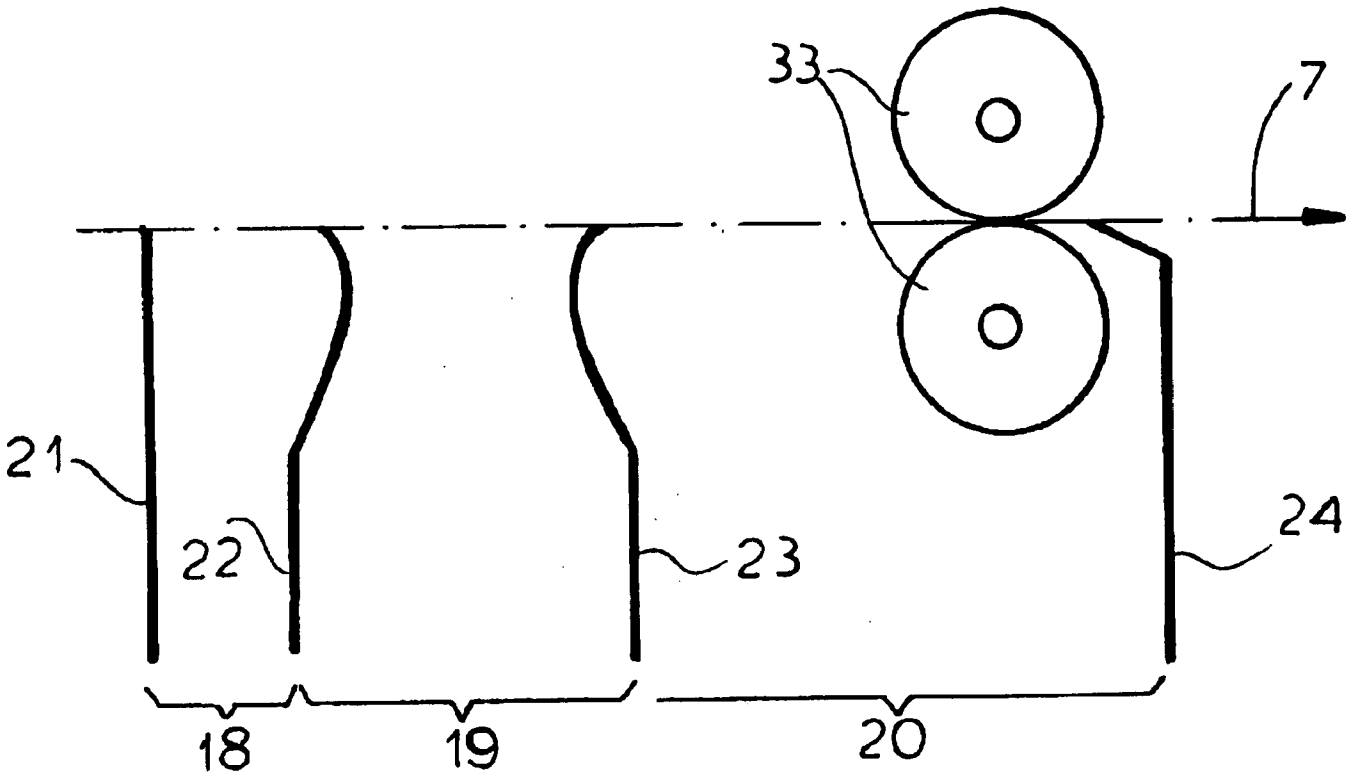
FIG. 4 is an enlarged section IV of the object shown in FIG. 1.

FIG. 4 shows a continuously moving deposit screen 7 for the filament non-woven fibrous web, not depicted. Preferably and shown in the exemplary embodiment, three suction regions 18, 19, 20 are arranged behind one another in the travel direction of the deposit screen 7. A primary suction region 19 is provided in the deposit region of the filament nonwoven fibrous web. An initial suction region 18 is provided in front of the deposit region and/or in front of the primary suction region 19. A second suction region 20 is provided behind the primary suction region 19.

In general, a separate suction blower may be allocated to every suction region 18, 19, 20. However, the scope of the invention also includes for the provision of one suction blower only, and for the respective suction conditions in the suction regions 18, 19, 20 to be adjusted by means of adjustment devices and chokes. The initial suction region 18 is limited by the walls 21 and 22. The second suction region 20 is limited by the walls 23 and 24. The walls 22, 23 of the primary suction region 19 form a jet contour.

Advantageously, the suction speed in the primary suction region 19 is higher than the suction speed in the initial suction region 18 and in the second suction region 20. The scope of the invention includes for the suction strength in the primary suction region 19 to be independently adjusted and/or controlled from the suction strength in the initial suction region 18 and in the second suction region 20. The object of the initial suction region 18 is to remove the air introduced with the deposit screen 7 and to direct the flow vectors at the boundary to the primary suction region 19 orthogonally with respect to the deposit screen 7.

Additionally, the initial suction region 18 serves to keep the filaments already deposited securely on the deposit screen 7. The air traveling with the filaments is to freely exit the primary suction region 19 so that the non-woven fibrous web can securely be deposited. The second suction region 20, positioned behind the primary suction region 19, serves to secure the transport and/or to hold the nonwoven fibrous web deposited on The deposit screen 7. At least a part of the second suction region 20 to be arranged in front of the pair of pressure rollers 33 in the travel direction of the screen 7. Advantageously, at least one third of the length of The second suction region 20, preferably at least half of the length of the second suction region 20 is positioned in front of the pair of pressure rollers 33, with respect to the transportation direction.

Figure 5:
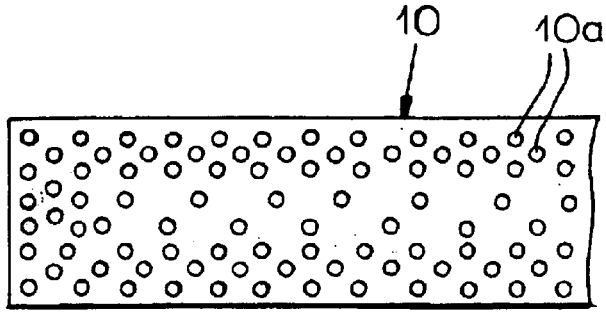
FIG. 5 is a bottom view of a spinneret or spinning plate in accordance with the invention.

In FIG. 5, we have shown a spinneret plate for the spinneret 1 of FIG. 1, which is supplied with the thermoplastic synthetic resin from an extruder 1*a* and which corresponds to the jet plate 10 of FIG. 1. That jet plate 10 is provided with orifices 10*a* which are more closely spaced around the periphery of the plate 10 than at the center thereof.

Figure 6:
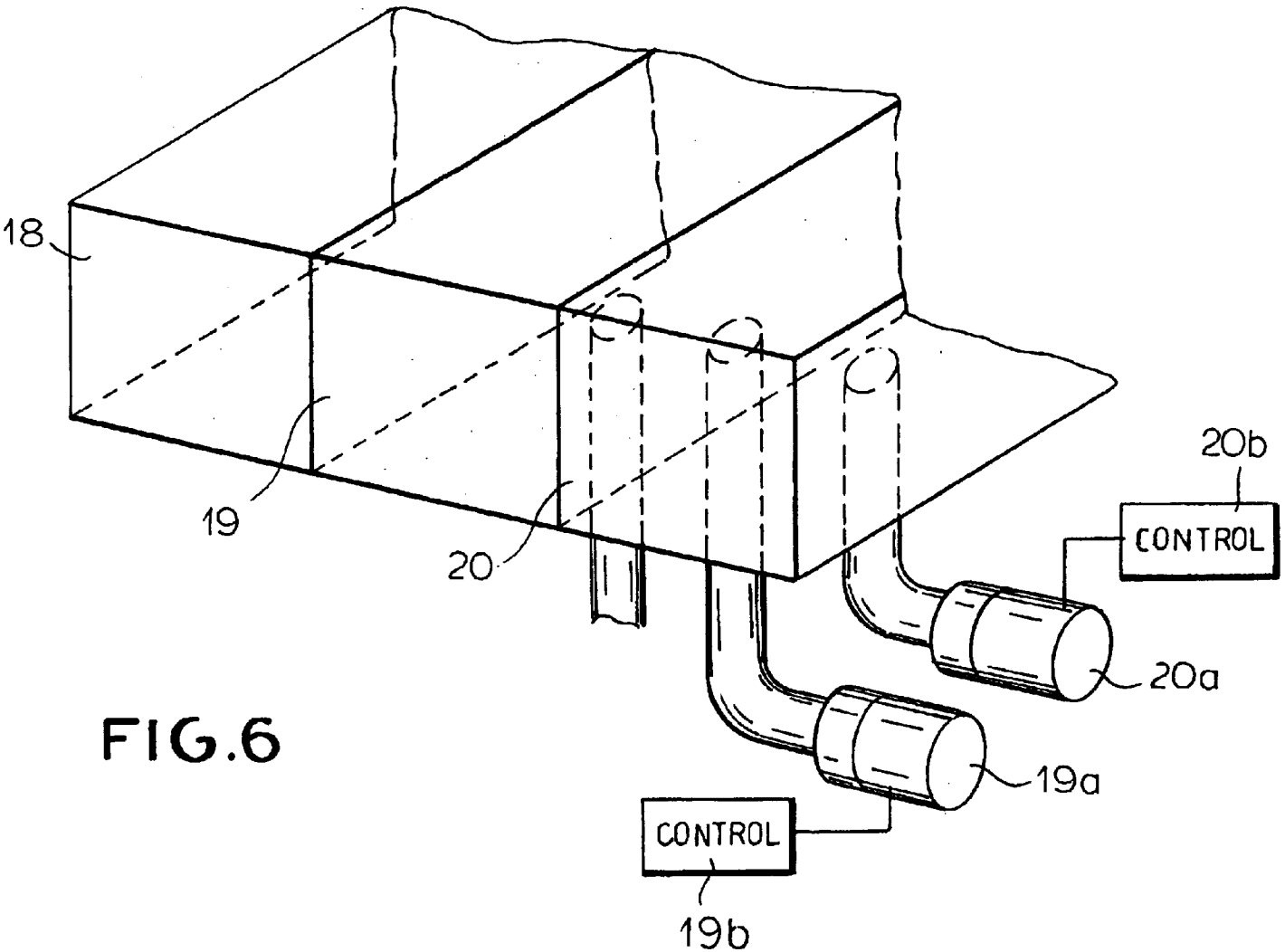
FIG. 6 is a perspective view of the lower portions of the suction boxes forming the suction regions over which the collecting screen travels.

In FIG. 6, we show the suction boxes for the regions 18, 19 and 20 provided with respective suction blowers 19*a*, 20*a*, etc. each with its individual control 19*b*, 20*b* for the blower drive motor, enabling the suction force of suction velocity and the flow rates to be individually controlled.

We claim:

1. An apparatus for producing a nonwoven fibrous web comprising:

a spinneret for producing a descending curtain of thermoplastic synthetic resin filaments;

a cooling chamber below said spinneret and forming a passage receiving said descending curtain of thermoplastic synthetic resin filaments;

a stretching unit below said passage and connected thereto to exclude entry of external air for aerodynamically stretching said filaments as said filaments pass downwardly from said passage through said stretching unit, said stretching unit having a draft channel at a bottom thereof;

an air supply chamber adjacent said cooling chamber and communicating with said passage through openings in walls of said cooling chamber for introducing process air into said passage, cooling said filaments and passing with said filaments into said stretching unit, said air supply chamber being subdivided into a first chamber section and a second chamber section in a direction of travel of said filaments provided with means for introducing air of different temperatures into said passage; and a collecting device below said stretching unit for collecting aerodynamically stretched filaments in the form of a continuous web.

2. The apparatus defined in claim 1 wherein said first and second chamber sections are respectively configured to supply air at a temperature of 15° C. to 75° C. and at a temperature of 15° C. to 38° C. to maid passage.

3. The apparatus defined in claim 2 wherein said first and second chamber sections are respectively configured to supply air at a temperature of 15° C. to 70° C. and at a temperature of 15° C. to 35° C. to said passage.

4. The apparatus defined in claim 3 wherein said spinneret has a multiplicity of spaced-apart filament-emitting orifices and a mutual spacing of said orifices is greater at a middle of the spinneret than at exterior regions thereof.

5. The apparatus defined in claim 4, further comprising a monomer-suction device between the spinneret and said air supply chamber for drawing off gases developing during spinning of said filaments.

6. The apparatus defined in claim 5, further comprising an intermediate channel extending between said passage and said stretching unit and having walls converging downwardly at an adjustable angle.

7. The apparatus defined in claim 6, further comprising a tiering unit with at least one diffuser between said stretching unit and said collecting device.

8. The apparatus defined in claim 7 wherein said tiering unit comprises a first diffuser and a second diffuser traversed by said filaments in succession in said direction, said first and second diffusers having a gap between them for admission of ambient air.

9. The apparatus defined in claim 8 wherein said collecting device comprises a continuously movable deposit screen upon which said web is formed and a suction device below said screen.

10. The apparatus defined in claim 9 wherein said suction device comprises at least three suction regions arranged in succession below said screen in a direction of travel thereof including a primary suction region directly below said stretching unit and additional suction regions upstream and downstream of said primary suction region in said direction of travel.

11. The apparatus defined in claim 10, further comprising means for adjusting a suction strength in said primary region independently from suction strengths in said additional regions.

12. The apparatus defined in claim 1 wherein said spinneret has a multiplicity of spaced-apart filament-emitting orifices and a mutual spacing of said orifices is greater at a middle of the spinneret than at exterior regions thereof.

13. The apparatus defined in claim 1, further comprising a monomer-suction device between the spinneret and said air supply chamber for drawing off gases developing during spinning of said filaments.

14. The apparatus defined in claim 1, further comprising an intermediate channel extending between said passage and said stretching unit and having walls converging downwardly at an adjustable angle.

15. The apparatus defined in claim 1, further comprising a tiering unit with at least one diffuser between said stretching unit and said collecting device.

16. The apparatus defined in claim 15 wherein said tiering unit comprises a first diffuser and a second diffuser traversed by said filaments in succession in said direction, said first and second diffusers having a gap between them for admission of ambient air.

17. The apparatus defined in claim 1 wherein said collecting device comprises a continuously movable deposit screen upon which said web is formed and a suction device below said screen.

18. The apparatus defined in claim 17 wherein said suction device comprises at least three suction regions arranged in succession below said screen in a direction of travel thereof including a primary suction region directly below said stretching unit and additional suction regions upstream and downstream of said primary suction region in said direction of travel.

19. The apparatus defined in claim 18, further comprising means for adjusting a suction strength in said primary region independently from suction strengths in said additional regions.

20. A method of operating an apparatus for producing a nonwoven fibrous web comprising the steps of:

spinning a descending curtain of thermoplastic synthetic resin filaments;

cooling said curtain in a cooling chamber forming a passage receiving said descending curtain of thermoplastic synthetic resin filaments;

aerodynamically stretching the cooled filaments in a stretching unit below said passage and connected thereto to exclude entry of external air, said stretching unit having a draft channel at a bottom thereof;

feeding process air to said passage through an air supply chamber adjacent said cooling chamber and communicating with said passage through openings in walls of said cooling chamber, said air supply chamber being subdivided into a first chamber section and a second chamber section in a direction of travel of said filaments introducing air at a temperature of 15° C. to 75° C. and at a temperature of 15° C. to 38° C. to said passage, respectively; and below said stretching unit collecting aerodynamically stretched filaments in the form of a continuous web.

* * * * *

US006918750C1

(12) EX PARTE REEXAMINATION CERTIFICATE (6892nd)

United States Patent

Geus et al.

(10) Number: US 6,918,750 C1

(45) Certificate Issued: Jun. 23, 2009

(54) ARRANGEMENT FOR THE CONTINUOUS PRODUCTION OF A FILAMENT NONWOVEN FIBROUS WEB

(75) Inventors: Hans-Georg Geus, Niederkassel-Rheidt (DE); Detlef Frey, Niederkassel (DE); Peter Schlag, Troisdorf (DE)

(73) Assignee: Reifenhauser GmbH & Co. Maschinenfabrik, Troisdorf (DE)

Reexamination Request:
No. 90/009,236, Aug. 1, 2008

Reexamination Certificate for:

| | |
|---|---|
| Patent No.: | **6,918,750** |
| Issued: | **Jul. 19, 2005** |
| Appl. No.: | **10/375,892** |
| Filed: | **Feb. 27, 2003** |

(30) Foreign Application Priority Data

Feb. 28, 2002 (EP) ..... 02004615

(51) Int. Cl.

| | |
|---|---|
| ***D01D 5/098*** | (2006.01) |
| ***D01D 5/088*** | (2006.01) |
| ***D01D 5/08*** | (2006.01) |
| ***D04H 3/16*** | (2006.01) |

(52) U.S. Cl. ..... 425/66; 156/441; 264/210.8; 425/72.2

(58) Field of Classification Search ..... None
See application file for complete search history.

(56) References Cited

U.S. PATENT DOCUMENTS

| | | | | | |
|---|---|---|---|---|---|
| 4,851,179 | A | * | 7/1989 | Reifenhauser | 264/555 |
| 5,800,840 | A | * | 9/1998 | Geus et al. | 425/7 |
| 5,814,349 | A | * | 9/1998 | Geus et al. | 425/66 |
| 6,379,136 | B1 | * | 4/2002 | Najour et al. | 425/83.1 |
| 6,499,982 | B2 | * | 12/2002 | Allen et al. | 425/83.1 |
| 2003/0178741 | A1 | * | 9/2003 | Hisada et al. | 264/211.22 |

FOREIGN PATENT DOCUMENTS

| | | | |
|---|---|---|---|
| EP | 0334604 | A2 * | 9/1989 |
| IT | 01245831 | * | 10/1994 |
| WO | WO 02/084007 | A1 * | 10/2002 |

* cited by examiner

*Primary Examiner*—Alan Diamond

(57) ABSTRACT

A spun-bond web-making apparatus has the cooling passage below the spinneret provided with a plurality of air chamber sections which are supplied with air at different temperatures, the cooling passage being connected to the drawing unit for aerodynamic stretching of the filaments without a gap through which external air can be supplied.

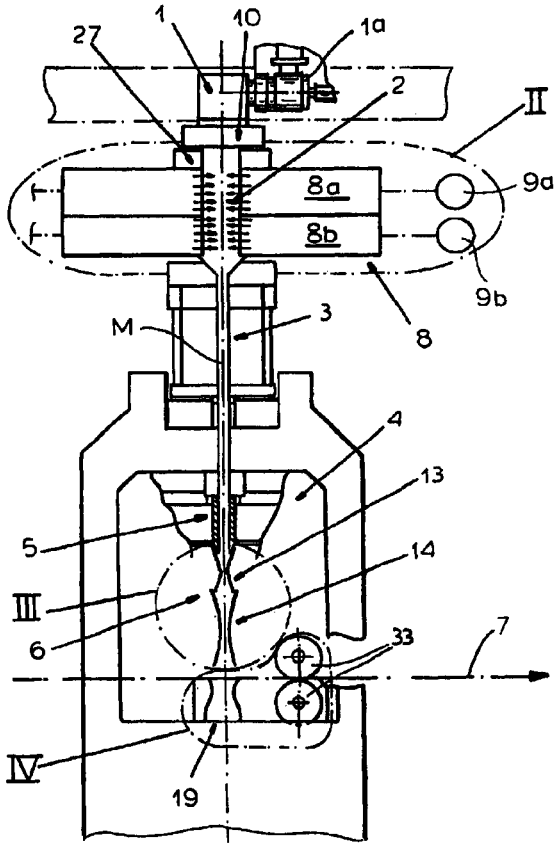

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 7, 8, 15 and 16 are cancelled.

Claims 1, 9 and 20 are determined to be patentable as amended.

Claims 2–6, 10–14 and 17–19, dependent on an amended claim, are determined to be patentable.

1. An apparatus for producing a nonwoven fibrous web, *the apparatus* comprising:

a spinneret for producing a descending curtain of thermoplastic synthetic resin filaments;

a cooling chamber below said spinneret and forming a passage receiving said descending curtain of thermoplastic synthetic resin filaments;

a stretching unit below said passage and connected thereto to exclude entry of external air for aerodynamically stretching said filaments as said filaments pass downwardly from said passage through said stretching unit, said stretching unit having a draft channel at a bottom thereof;

an air supply chamber adjacent said cooling chamber and communicating with said passage through openings in walls of said cooling chamber for introducing process air into said passage, cooling said filaments and passing with said filaments into said stretching unit, said air supply chamber being subdivided into a first chamber section and a second chamber section in a direction of travel of said filaments provided with means for introducing air of different temperatures into said passage*;*

*a first diffuser and a second diffuser below the stretching unit and traversed by said filaments in succession in said direction, said first and second diffusers having a gap between them for admission of ambient air and otherwise being closed to entry of ambient air*; and a collecting device below [said stretching unit] *the second diffusor* for collecting aerodynamically stretched filaments in the form of a continuous web.

9. The apparatus defined in claim [8] *1* wherein said collecting device comprises a continuously movable deposit screen upon which said web is formed and a suction device below said screen.

20. A method of operating an apparatus for producing a nonwoven fibrous web, *the method* comprising the steps of:

spinning a descending curtain of thermoplastic synthetic resin filaments;

cooling said curtain in a cooling chamber forming a passage receiving said descending curtain of thermoplastic synthetic resin filaments;

aerodynamically stretching the cooled filaments in a stretching unit below said passage and connected thereto to exclude entry of external air, said stretching unit having a draft channel at a bottom thereof;

feeding process air to said passage through an air supply chamber adjacent said cooling chamber and communicating with said passage through openings in walls of said cooling chamber, said air supply chamber being subdivided into a first chamber section and a second chamber section in a direction of travel of said filaments introducing air at a temperature of 15° C to 75° and at a temperature of 15° C to 38° C to said passage, respectively;

*conducting the filaments from the stretching unit down through a first diffusor and then through a second diffusor;*

*admitting ambient air into the diffusors through a gap between the first and second diffusors while otherwise excluding entry of ambient air into the diffusors*; and below [said stretching unit] *the second diffusor* collecting aerodynamically stretched filaments in the form of a continuous web.

* * * * *